US007438737B2

(12) United States Patent
Song et al.

(10) Patent No.: US 7,438,737 B2
(45) Date of Patent: Oct. 21, 2008

(54) VACUUM CLEANER

(75) Inventors: Hwa Gyu Song, Gwangju (KR); Jun Hwa Lee, Anyang-Si (KR); Jae Man Joo, Suwon-Si (KR); Soo Yong Choi, Seoul (KR); Seung Gee Hong, Yongin-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 600 days.

(21) Appl. No.: 11/142,380

(22) Filed: Jun. 2, 2005

(65) Prior Publication Data

US 2006/0048487 A1 Mar. 9, 2006

(30) Foreign Application Priority Data

Sep. 4, 2004 (KR) ..... 10-2004-0070604

(51) Int. Cl.
*B01D 45/12* (2006.01)

(52) U.S. Cl. ..... 55/343; 55/349; 55/459.1; 55/DIG. 3; 96/380

(58) Field of Classification Search ..... 55/343, 55/348, 349, 459.1, DIG. 3; 96/380
See application file for complete search history.

(56) References Cited

U.S. PATENT DOCUMENTS

| | | | | |
|---|---|---|---|---|
| 4,878,810 | A | 11/1989 | Evans | |
| 5,221,301 | A | 6/1993 | Giuricich | |
| 6,607,572 | B2 * | 8/2003 | Gammack et al. | 55/343 |

FOREIGN PATENT DOCUMENTS

| | | | |
|---|---|---|---|
| CN | 1296801 | A | 5/2001 |
| GB | 2 054 058 | A | 2/1981 |
| GB | 2 399 780 | A | 9/2004 |
| KR | 2002-0078798 | A | 10/2002 |
| WO | WO 02/067756 | A1 | 9/2002 |
| WO | WO 02/067757 | A1 | 9/2002 |

* cited by examiner

*Primary Examiner*—Robert A Hopkins
(74) *Attorney, Agent, or Firm*—Sughrue Mion, PLLC

(57) ABSTRACT

A cyclone vacuum cleaner including a plurality of cyclone chambers arranged in a group. The cyclone chambers are configured such that frequency characteristics of noises generated from respective cyclone chambers are different from each other.

16 Claims, 8 Drawing Sheets

VACUUM CLEANER

CROSS-REFERENCE TO RELATED APPLICATION

This application claims the benefit of Korean Patent Application No. 2004-70604, filed on Sep. 4, 2004 in the Korean Intellectual Property Office, the disclosure of which is incorporated herein by reference.

BACKGROUND OF THE INVENTION

1. Field of the Invention

The present invention relates to a vacuum cleaner, particularly to a vacuum cleaner having a plurality of cyclone chambers for separating air and dust.

2. Description of the Related Art

Generally, vacuum cleaners suck waste and dust together with air using suction power of a blower, and separate the sucked waste and dust contained in the sucked air from the sucked air by a filter so as to clean indoor spaces.

Recently, cyclone vacuum cleaners have been developed, wherein a cyclone chamber is installed, instead of a filter for separating waste from polluted air sucked into the vacuum cleaner, so as to generate a swirling air stream of sucked air, to separate waste and dust from the sucked polluted air, and to enable a user to easily dispose of the collected waste and dust. Among cyclone vacuum cleaners, Korean Patent Laid-open Publication No. 2003-0081443 discloses a cyclone vacuum cleaner in which a plurality of cyclone chambers are installed in serial or in parallel so as to effectively separate dust from the sucked air.

However, according the conventional cyclone vacuum cleaners, since a plurality of equally sized and configured cyclone chambers are provided in the cyclone vacuum cleaner, noise generated from respective cyclone chambers is superposed and the superposition of noise causes louder noise when the cyclone vacuum cleaner is driven. In other words, since the size and configuration of respective cyclone chambers are identical, noise is very loud due to the phenomenon (phenomenon that noise is superposed) that frequencies of noises generated from respective cyclone chambers coincide with each other.

SUMMARY OF THE INVENTION

The present invention has been made in view of the above-mentioned problems, and an aspect of the invention is to provide a vacuum cleaner constructed such that noise generated from a plurality of cyclone chambers have frequency characteristics different from each other so as to reduce operative noise of the vacuum cleaner by preventing superposition of noises in specific frequency bands.

In accordance with one aspect, the present invention provides a vacuum cleaner including a plurality of cyclone chambers arranged in a group and configured such that frequency characteristics of noises generated from respective cyclone chambers are different from each other.

It may be preferable that the cyclone chambers include outlets, and extending pipes extended from the outlets and having unique lengths.

According to the cyclone vacuum cleaner, volumes of the cyclone chambers may be different from each other.

It may be preferable that the cyclone chambers have a cone-shape, and include extending pipes extended from portions with maximal diameter of the cyclone chambers and having unique lengths.

It may be preferable that the cyclone chambers have outlets formed at ends thereof for exhausting dust, and extending pipes extended from the outlets and having unique lengths.

It may be preferable that the cyclone chambers are cone shaped and have outlets formed at a minimum diameter portion.

It may be preferable that the cyclone chambers are arranged in parallel.

It may be preferable that the cyclone chambers have different maximal diameters.

It may be preferable that the cyclone chambers include outlets with different diameters.

In accordance with another aspect, the present invention provides a vacuum cleaner including a first cyclone chamber for separating relatively large foreign matter from air, and a plurality of second cyclone chambers smaller than the first cyclone chamber and separating fine dust from the air passed through the first cyclone chamber, wherein configurations of the second cyclone chambers are different from each other so as to allow frequency characteristics of noise generated from the second cyclone chambers to be different from each other.

It may be preferable that the second cyclone chambers include outlets and extending pipes of different lengths extending from the outlets.

It may be preferable that the second cyclone chambers have different volumes than each other.

It may be preferable that the second cyclone chambers have a cone-shape.

It may be preferable that the second cyclone chambers include extending pipes which extend from the portions of the second cyclone chambers with maximal diameters.

It may be preferable that the second cyclone chambers have a cone-shape, include outlets for exhausting dust and include extending pipes of different lengths extending from the outlets.

It may be preferable that the second cyclone chambers have different maximal diameters.

It may be preferable that the second cyclone chambers have outlets with different diameters.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

Figure 1:
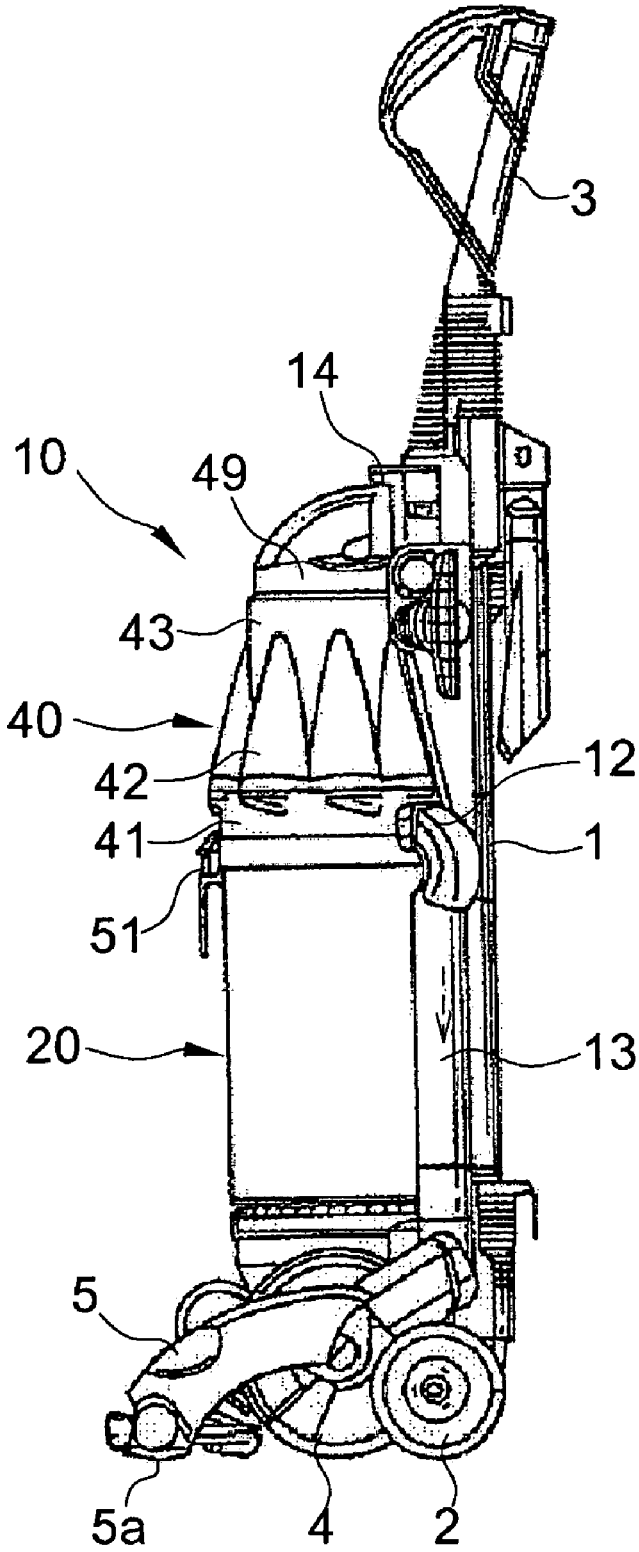
FIG. 1 is a side view illustrating a cyclone vacuum cleaner according to an exemplary embodiment of the present invention.

DETAILED DESCRIPTION OF THE ILLUSTRATIVE NON-LIMITING EMBODIMENTS OF THE INVENTION

Reference will now be made in detail to exemplary embodiments of the present invention, examples of which are illustrated in the accompanying drawings, wherein like reference numerals refer to the like elements throughout. The exemplary embodiments are described below to assist in the understanding of the invention, and are not intended to limit the scope of the invention in any way.

The cyclone vacuum cleaner according to an exemplary embodiment of the present invention, as shown in FIG. 1, includes an upright body 1 having wheels 2 provided at the lower side thereof and a grip 3 provided at the upper side thereof, a blower unit 4 installed at the lower side of the upright body 1, a suction unit 5 for guiding air and foreign matter (waste or dust), at the cleaning side of the cyclone vacuum cleaner, to be sucked, and a detachable cyclone separator 10 installed to the upright body 1 and disposed above the blower unit 4, for separating and collecting waste or dust from air blown by the blower unit 4.

The suction unit 5 is constructed in the form of a duct in which an inlet 5*a* is provided at the end adjacent to the cleaning surface of the indoor space, and coupled with the blower unit 4 via joints. A passage communicated with the suction unit 5, not shown in detail in the drawing, is communicated with an inlet 11 (See FIGS. 3 and 5) of the later-described cyclone separator 10 through general pipes or hoses. As such, the sucked air and foreign matter can be guided to flow toward the inlet 11 of the cyclone separator 10.

Figure 2:
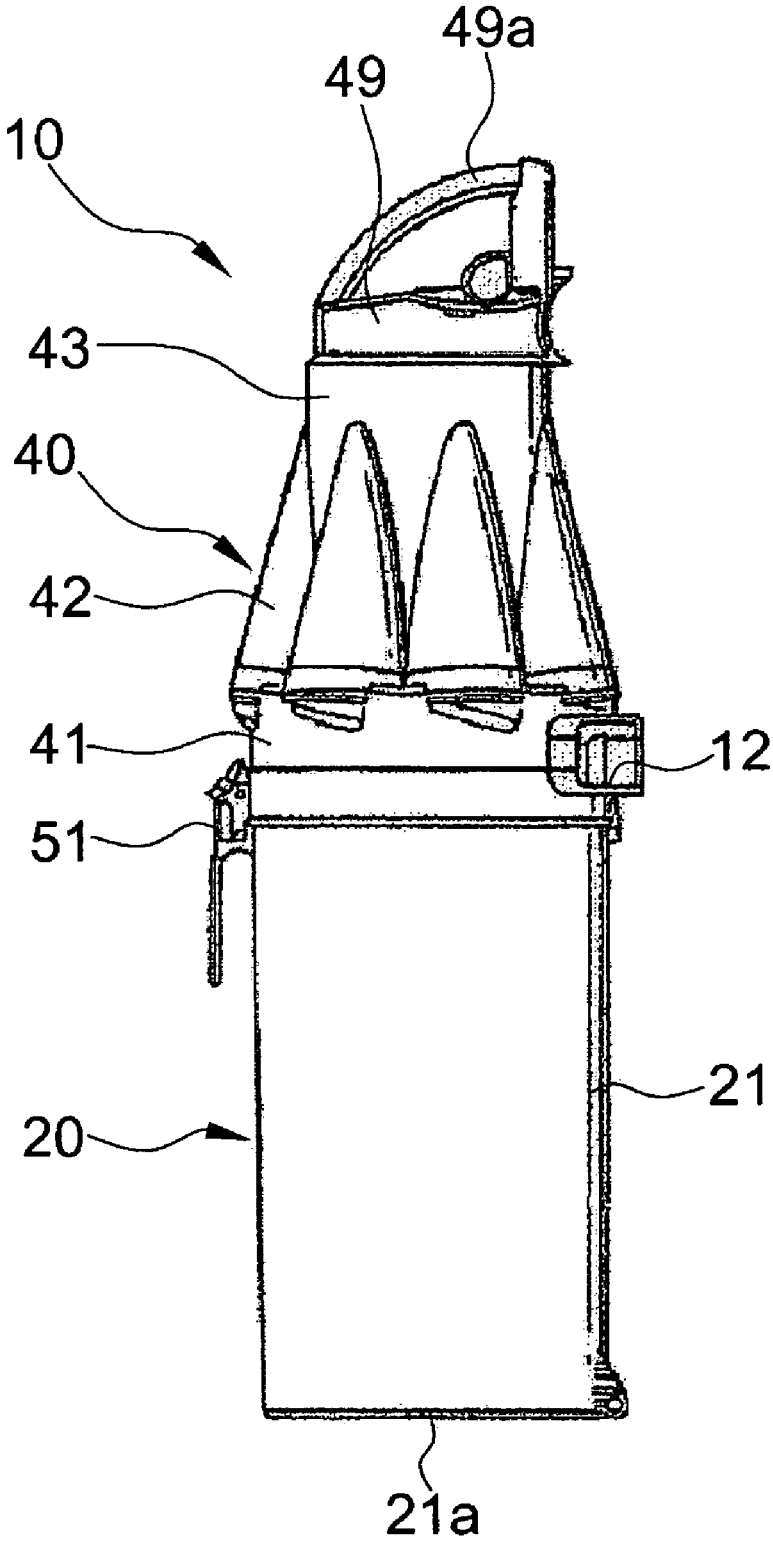
FIG. 2 is a side view illustrating a cyclone separator of the cyclone vacuum cleaner according to an exemplary embodiment of the present invention.

The blower unit 4 is not depicted in detail in the drawings, but includes a blower fan for generating suction power and a motor for driving the blower fan. The blower unit 4, as shown in FIGS. 1 and 2, is connected to a discharge guide member 13 extended from an outlet 12 of the cyclone separator 10 to the lower side. As such, the clean air from which foreign matter has been removed by being filtered while passing through the cyclone separator 10 is sucked into the blower unit 4 via the discharge guide member 13, and is discharged into indoor space again. The air discharged through the blower unit 4 cools the motor for driving the blower unit 4 and is discharged into the indoor space.

The cyclone separator 10 disposed above the blower unit 4, as shown in FIG. 1, is detachably installed to the body 1 by a fastening device 14. The cyclone separator 10, as shown in FIGS. 2 and 3, includes a first cyclone unit 20 disposed at the lower side and collecting dust or waste contained in the sucked air, and a second cyclone unit 40 installed at the upper side of the first cyclone unit 20 and filtering fine dust contained in the air passed through the first cyclone unit 20.

Figure 4:
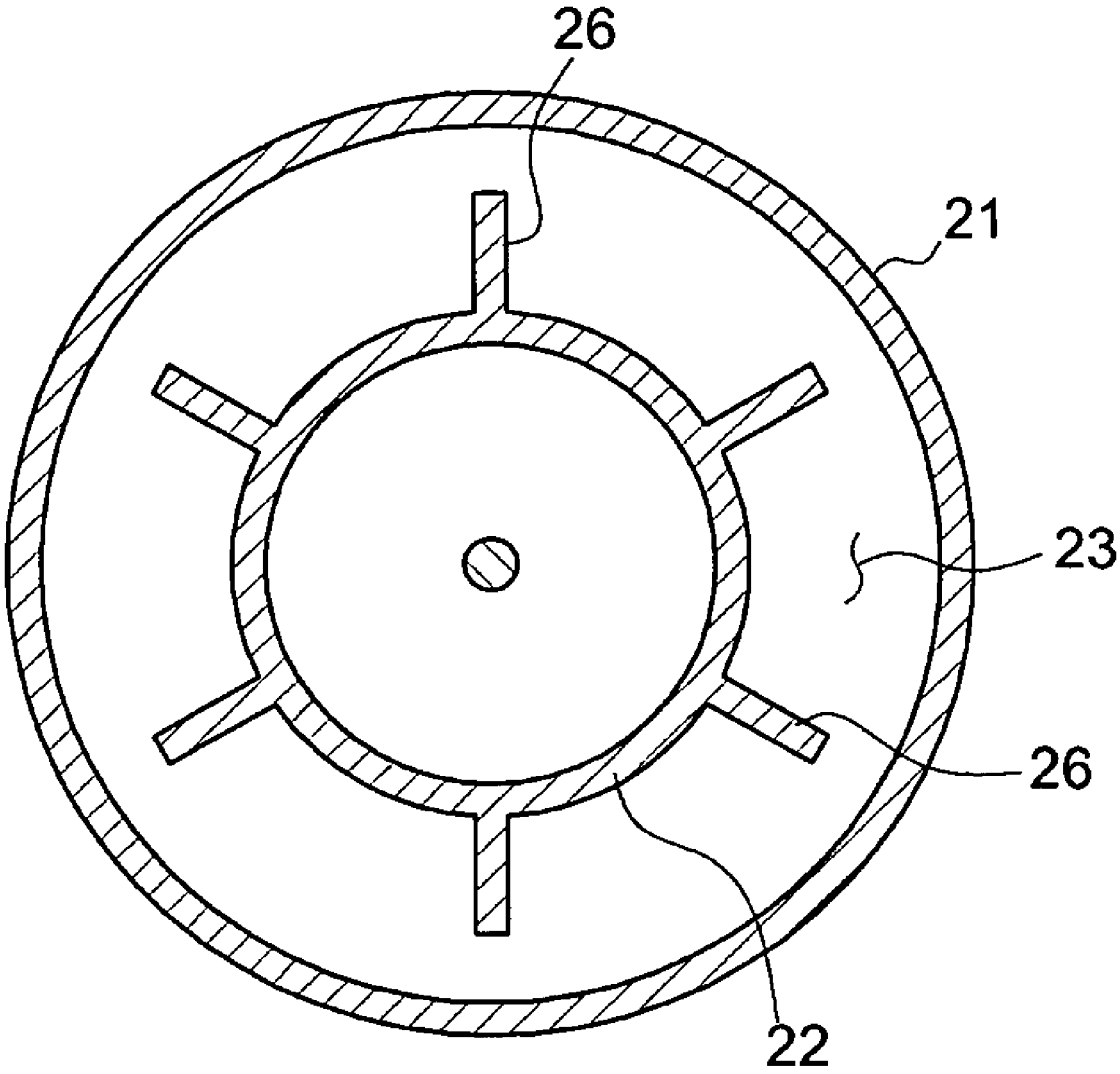
FIG. 4 is a sectional view taken along the line IV-IV in FIG. 3.

The first cyclone unit 20, disposed at the lower side, includes a cylindrical outer vessel 21 having an open upper side, and a cylindrical inner vessel 22 installed in the central portion of the outer vessel 21. The space between the outer vessel 21 and the inner vessel 22 forms a first cyclone chamber 23 for collecting dust or waste. The outer vessel 21 has a lower side closed by a lower plate 21*a* for opening and closing the lower side of the outer vessel 21 so as to exhaust the foreign matter accumulated in the first cyclone chamber 23, and the inlet 11 formed at the upper side of the outer vessel 21 and communicated with a passage of the suction unit 5. The first cyclone chamber 23 further includes a cylindrical partition member 24, disposed at the upper side of the first cyclone chamber 23, for dividing the inner space of the first cyclone chamber 23 and forming a rising passage 25, and a plurality of baffles 26, as shown in FIG. 4, disposed at the lower outer surface of the inner vessel 22 and extended from the outer surface of the inner vessel 22 in the radial direction so as to filter large-sized foreign matter contained in the air swirled within the first cyclone chamber 23. The baffles 26 are extended from the lower end of the partition member 24 to the lower side of the inner vessel 22.

The first cyclone unit 20 is constructed such that the air enters the upper space of the first cyclone chamber 23 through the inlet 11 of the outer vessel 21, swirls, falls along the inner wall of the outer vessel 21, and flows toward the second cyclone unit 40 disposed above the first cyclone unit 20 through the rising passage 25 disposed between the outer surface of the inner vessel 22 and the partition member 24. Due to the centrifugal force of the swirling air, relatively large dust and waste are separated from the swirling air and collected in the lower space 23*a* of the first cyclone chamber 23. The baffles 26 provided at the outer surface of the inner vessel 22 aid in separation of the large dust and waste from the air.

Figure 3:
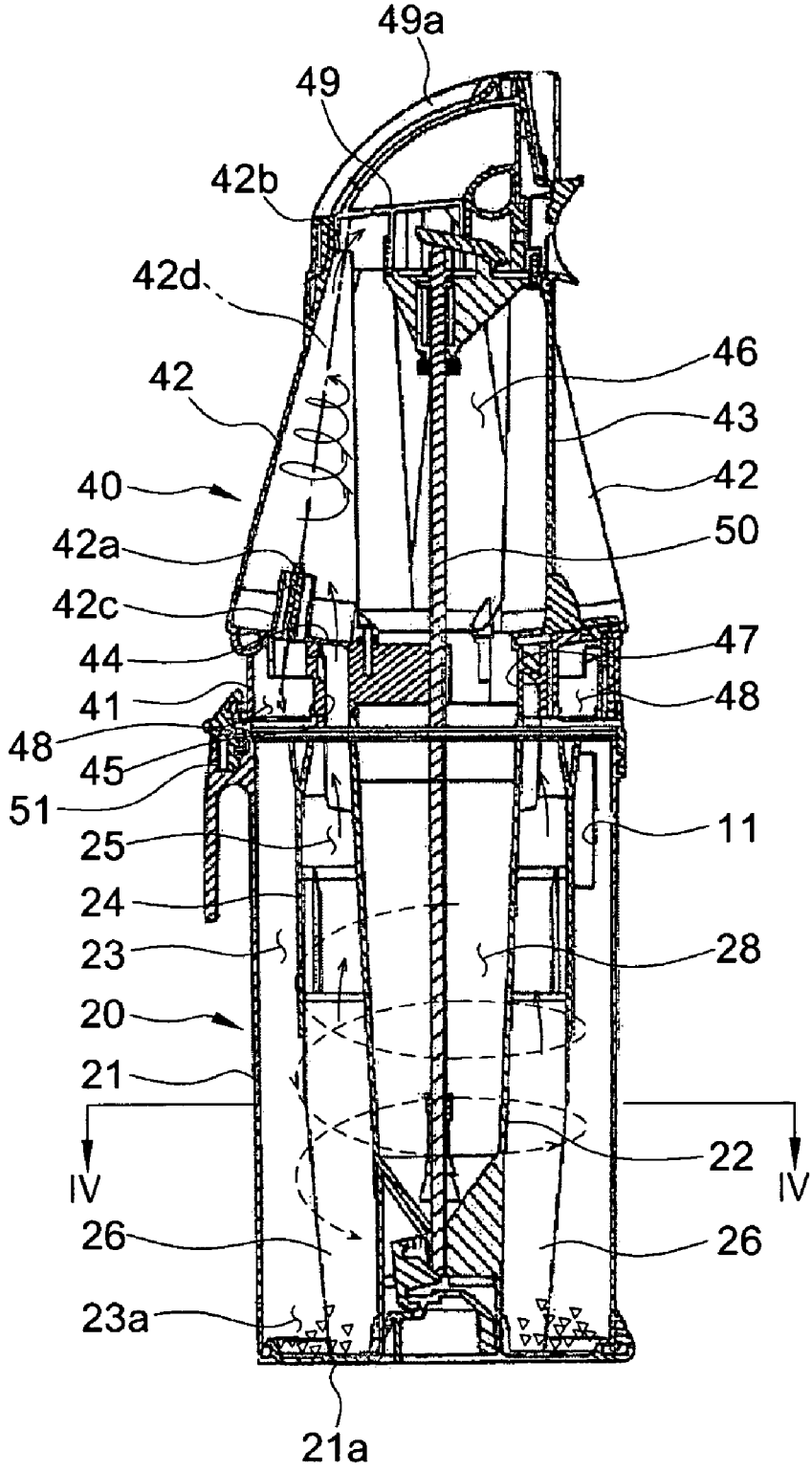
FIG. 3 is a sectional view illustrating the inner structure of the cyclone separator of the cyclone vacuum cleaner according to an exemplary embodiment of the present invention.
Figure 5:
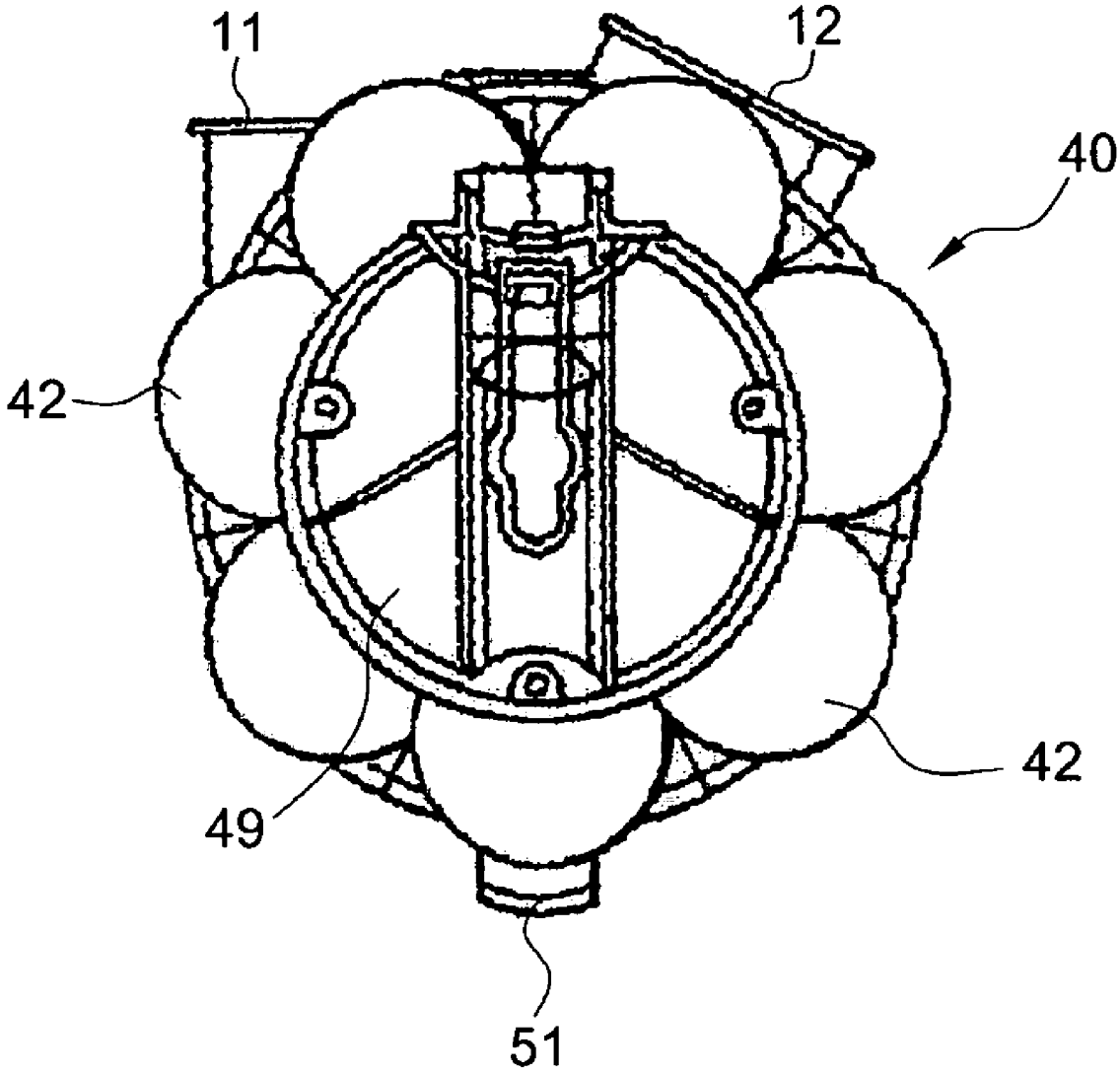
FIG. 5 is a plan view illustrating the cyclone separator of the cyclone vacuum cleaner according to an exemplary embodiment of the present invention.

The upper second cyclone unit 40, as shown in FIGS. 2, 3, and 5, includes a cylindrical connecting member 41 connected to the upper end of the outer vessel 21 of the first cyclone unit 20, and a plurality of second cyclone chambers 42 coupled to the upper side of the connecting member 41 and having cone-shaped inner spaces. The second cyclone chambers 42 are disposed on the cylindrical member 43 forming a dust exhaust passage in the radial direction, and are integrally formed with the cylindrical member 43 by general plastic injection molding and connected to each other.

Moreover, the second cyclone chambers 42 have first outlets 42*a* formed at the central lower side thereof and discharging clean air, and second outlets 42*b* formed at the upper end thereof and exhausting fine dust. The first outlets 42*a* are formed by extending pipes 42*c* extended from the lower central portion of the second cyclone chambers 42 to the inner upper sides thereof. The second cyclone chambers 42 further include inlets 44 communicated with the rising passage 25 of the first cyclone unit 20 and formed at the lower outside thereof, and the connecting member 41 further includes a plurality of communicating passages 45 communicated with the rising passage 25 and the respective inlets 44 of the second cyclone chambers 42.

The respective second cyclone chambers 42 are constructed such that lower sides with large diameters protrude from the cylindrical member 43, and their central axes 42*d* are slanted so as to dispose the upper second outlets 42*b* in the cylindrical member 43. As such, fine dust exhausted through the second outlets 42*b* drops to the lower side through an inner passage 46 of the cylindrical member 43 and is collected the inner space of the inner vessel 22 of the first cyclone unit 20. For the purpose of collecting dust in the inner space of the inner vessel 22, the connecting member 41 includes a communication hole 47, formed at the central portion of the connecting member 41, for communicating the inner passage 46 of the cylindrical member 43 to the inner space 28 of the inner vessel 22 of the first cyclone unit 20.

The connecting member 41 includes a passage 48 formed at the internal outer side thereof and communicating with respective first outlets 42*a* of the second cyclone chambers 42. The passage 48 also communicates with the outlet 12 formed at the outer surface of the connecting member 41, as shown in FIGS. 1 and 2, so as to be connected to the discharge guide member 13. As such, the discharged clean air, having passed through the second cyclone chambers 42, can be guided toward the blower unit 4 by the discharge guide member 13. The upper open side of the cylindrical member 43 of the second cyclone unit 40 is coupled with a cover 49 having a grip 49*a* and is closed by the cover 49. The second cyclone unit 40 and the lower first cyclone unit 20 are associated with each other such that ends of a long adjusting bolt 50, aligned with the center lines of the second cyclone unit 40 and the first cyclone unit 20, are fastened to the lower sides of the cover 49 and the inner vessel 22, and the lower side of the connecting member 41 and the upper side of the outer vessel 21 are coupled by a coupling device 51.

The second cyclone unit 40 allows the clean air, which has been primarily purified while passing through the first cyclone unit 20, to pass through the communicating passages 45 of the connecting member 41 and to be discharged from the second cyclone chambers 42 again, so that the second cyclone unit 40 can collect the fine dust contained in the sucked air. In other words, as shown in FIG. 3, the air sucked in the second cyclone chambers 42 enters the cone-shaped second cyclone chambers 42 and swirls, and the fine dust is separated from the sucked air due to the centrifugal force of the swirling air. The purified air at the central portion of the second cyclone chambers 42 is discharged through the first outlets 42*a*, and the separated fine dust is exhausted into the cylindrical member 43 via the upper second outlets 42*b*. Thus, the separated fine dust drops along the passages 46 and is collected in the inner space 28 of the inner vessel 22 of the first cyclone unit 20. The clean air discharged through the first outlets 42*a* is supplied to the indoor space via the passages 48 of the connecting member 41, the discharge guide member 13, and the blower unit 4, again.

Meanwhile, when the vacuum cleaner is driven, since the air passing through the second cyclone chamber 42 rapidly swirls, noise is generated due to the air flow. According to the conventional vacuum cleaner, since respective cyclone chambers have similar sizes and configurations, and conditions of the air flowing through the second cyclone chambers, the frequencies of noises generated in respective cyclone chambers are nearly identical. Therefore, the noises may be superposed upon one another and amplified. However, according to an exemplary embodiment of the present invention, since the configurations of the second cyclone chambers 42 are different from each other, thus causing the frequencies of noises generated in respective cyclone chambers to differ from one another, amplification of the noise can be prevented.

Figure 6:
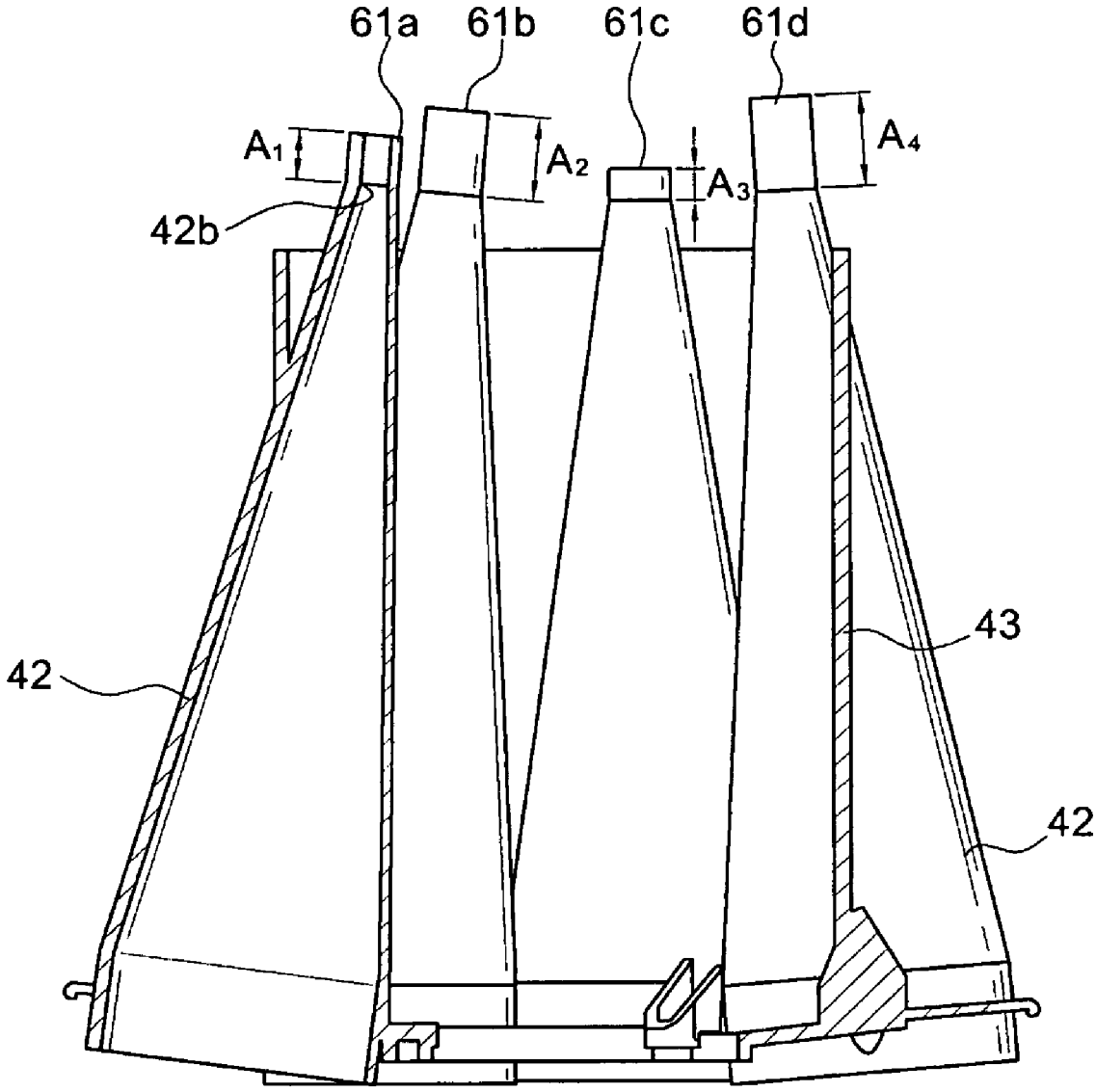
FIG. 6 is a sectional view illustrating an example of a second cyclone chamber of the cyclone vacuum cleaner according to an exemplary embodiment of the present invention.

FIG. 6 shows an example of the second cyclone chambers 42 constructed such that characteristics of noises generated in the second cyclone chambers 42 are different from each other. As shown in the drawing, extending pipes 61*a*, 61*b*, 61*c*, 61*d*, . . . , having different lengths A1, A2, A3, A4, . . . , are provided at the second outlets 42*b* of the second cyclone chambers 42. In other words, the extending pipes 61*a*, 61*b*, 61*c*, 61*d*, . . . having different lengths are provided at the second outlets 42*b* so that the noise characteristics of the air discharged through the second outlets 42*b* of the cyclone chambers 42 differ from one another so as to prevent the noises from being superposed upon one another. Since respective extending pipes 61*a*, 61*b*, 61*c*, 61*d*, . . . form narrow and long passages and serve as resistance against noise, respective extending pipes 61*a*, 61*b*, 61*c*, 61*d*, . . . damp noises generated from respective cyclone chambers so as to reduce noise generated when the vacuum cleaner is driven. Moreover, since respective lengths of the extending pipes 61*a*, 61*b*, 61*c*, 61*d*, . . . are different from each other, the noises generated from the second outlets 42 exhibit different frequency characteristics so as to prevent the amplification of noises due to the superposition of the noises.

Figure 7:
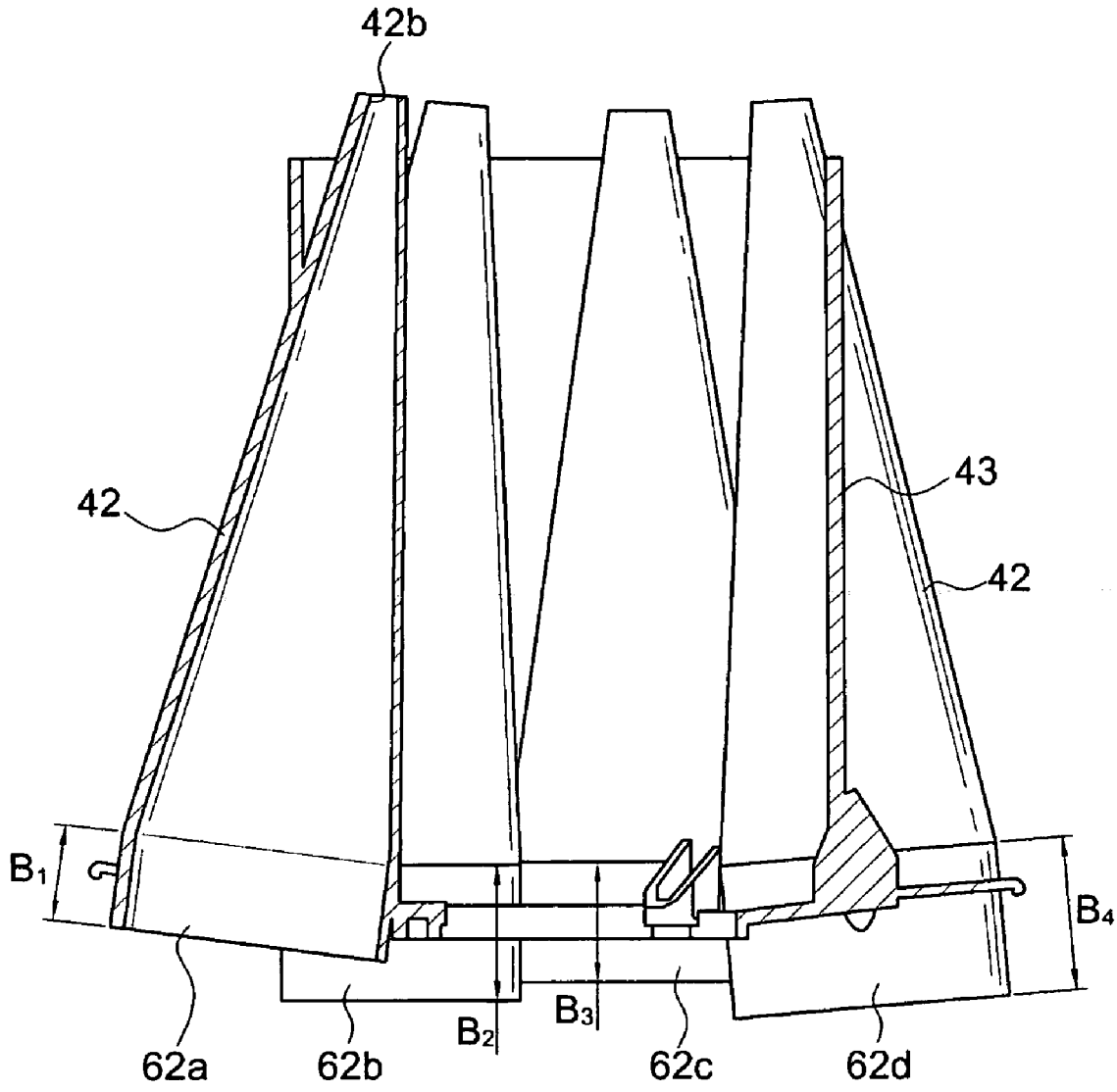
FIG. 7 is a sectional view illustrating another example of the second cyclone chamber of the cyclone vacuum cleaner according to an exemplary embodiment of the present invention.

FIG. 7 shows another example of the second cyclone chambers 42 constructed such that characteristics of noises generated in the second cyclone chambers 42 are different from each other. Different from the above-described example, extending pipes with unique lengths 62*a*, 62*b*, 62*c*, 62*d*, . . . are provided at the lower sides with large diameters of the second cyclone chambers 42. In other words, inner volumes of the cyclone chambers 42 and characteristics of the swirling air in the cyclone chambers 42 are different from each other due to the extending pipes 62*a*, 62*b*, 62*c*, 62*d*, . . . having different lengths, so as to make the characteristics of noises generated in the cyclone chambers 42 differ from one another. As such, the amplification of noise due to the superposition of noises can be prevented.

Figure 8:
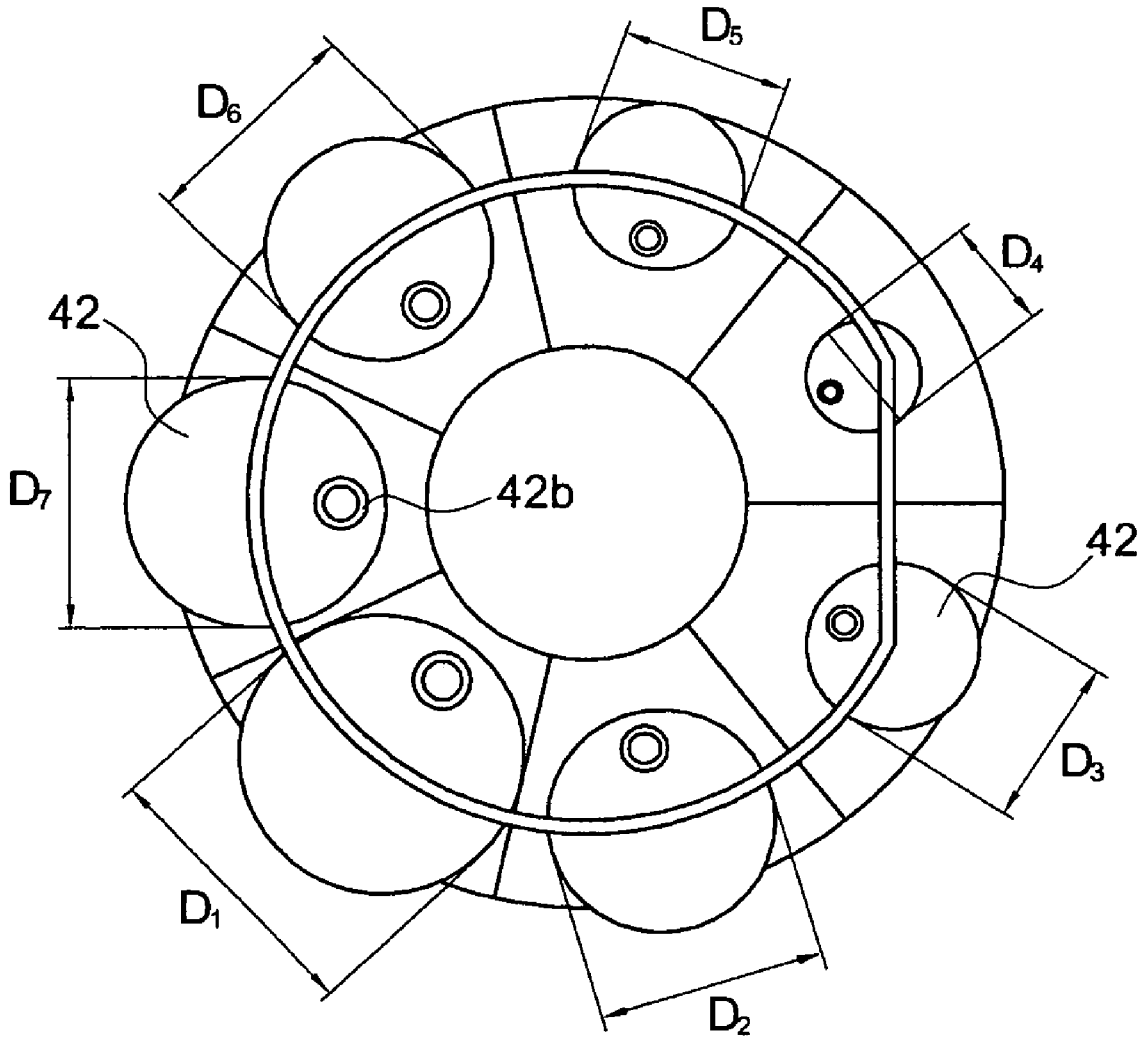
FIG. 8 is a plan view illustrating still another example of the second cyclone chamber of the cyclone vacuum cleaner according to an exemplary embodiment of the present invention.

FIG. 8 shows still another example of the second cyclone chambers 42 constructed such that characteristics of noises generated in the second cyclone chambers 42 differ from one another. The maximal diameters D1, D2, D3, D4, . . . , and D7 of respective chambers 42 and the sizes of the second outlets 42*b* are different from one another. This example can obtain the same effect as the above described examples by constructing the diameters of the cyclone chambers 42 and the sizes of the outlets to be different.

Moreover, according to an exemplary embodiment of the present invention, one of the above examples shown in FIGS. 6, 7, and 8, is applied to the second cyclone unit 40 so as to reduce noise, or several examples are employed so as to remarkably reduce noise.

As described above, according to the vacuum cleaner of the present invention, since the lengths and sizes of the outlets, the inner volumes, and the configurations of the cyclone chambers may be different from each other, the characteristics of noises generated from respective cyclone chambers are different from each other so as to prevent the superposition of noises at the specific frequency bands and to reduce noise generated when the vacuum cleaner is driven.

While the invention has been particularly shown and described with reference to exemplary embodiments thereof, the invention is not limited to these embodiments. It will be understood by those of ordinary skill in the art that various changes in form and details may be made therein without departing from the broad spirit and scope of the present invention.

What is claimed is:

1. A vacuum cleaner comprising:

a plurality of cyclone chambers arranged in a group;

wherein the configurations of the cyclone chambers are different from each other so that frequency characteristics of noises generated from respective cyclone chambers are different from each other;

wherein the cyclone chambers have a cone-shape; and wherein the cyclone chambers further comprise extending pipes extended from portions of the cyclone chambers with maximal diameter, and said extending pipes have lengths different from each other.

2. The vacuum cleaner as set forth in claim 1, wherein the cyclone chambers comprise:

outlets; and extending pipes extended from the outlets and having unique lengths.

3. The vacuum cleaner as set forth in claim 1, wherein volumes of the cyclone chambers are different from each other.

4. The vacuum cleaner as set forth in claim 1 wherein the cyclone chambers further comprise outlets formed at ends thereof, said cyclone chambers exhausting dust; and wherein extending pipes extend from the outlets and have lengths different from each other.

5. The vacuum cleaner according to claim 2, wherein the cyclone chambers have a cone-shape and said outlets are formed at a minimum diameter portion of said cyclone chambers.

6. The vacuum cleaner as set forth in claim 1, wherein the plurality of cyclone chambers are arranged in parallel.

7. The vacuum cleaner as set forth in claim 1, wherein the cyclone chambers have different maximal diameters.

8. The vacuum cleaner according to claim 1, wherein the cyclone chambers further comprise outlets, and said outlets have different diameters.

9. A vacuum cleaner comprising:

a first cyclone chamber separating large foreign matter from air; and a plurality of second cyclone chambers smaller than the first cyclone chamber and separating fine dust from the air passed through the first cyclone chamber, wherein configurations of the second cyclone chambers are different from each other so as to allow frequency characteristics of noises generated from the second cyclone chambers to be different from each other.

10. The vacuum cleaner as set forth in claim 9, wherein the second cyclone chambers comprise:

outlets; and extending pipes extended from the outlets and having lengths different from each other.

11. The vacuum cleaner as set forth in claim 9, wherein volumes of the second cyclone chambers are different from each other.

12. The vacuum cleaner as set forth in claim 9, wherein the second cyclone chambers have a cone-shape.

13. The vacuum cleaner as set forth in 12, wherein the second cyclone chambers further comprise extending pipes extended from portions of the second cyclone chambers with maximal diameter, and said extending pipes have lengths different from each other.

14. The vacuum cleaner as set forth in claim 12, wherein the second cyclone chambers further comprise outlets formed at ends thereof and exhausting dust; and wherein extending pipes extend from the outlets and have lengths different from each other.

15. The vacuum cleaner as set forth in claim 9, wherein the second cyclone chambers have different maximal diameters.

16. The vacuum cleaner according to claim 9, wherein the second cyclone chambers further comprise outlets, and said outlets have different diameters.

* * * * *